US006050051A

United States Patent [19]

Becker

[11] Patent Number: 6,050,051

[45] **Date of Patent: *Apr. 18, 2000**

[54] PROCESS FOR DAMP-PROOFING MASONRY

[75] Inventor: Horst Becker, Odenthal, Germany

[73] Assignee: ISOTEC Franchise-Systeme GmbH, Bergisch Gladbach, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/851,698

[22] Filed: May 6, 1997

[51] Int. Cl.[7] ..... E04B 1/00

[52] U.S. Cl. ..... 52/741.4; 52/411; 52/746.11; 401/1; 401/2

[58] Field of Search ..... 52/741.4, 411, 52/746.1; 401/1, 2, 40, 41

[56] References Cited

U.S. PATENT DOCUMENTS

| | | | |
|---|---|---|---|
| 4,065,214 | 12/1977 | Daum et al. | 401/2 |
| 5,479,753 | 1/1996 | Williams | 52/741.1 |
| 5,622,023 | 4/1997 | Crispino | 52/741.1 |

FOREIGN PATENT DOCUMENTS

| | | |
|---|---|---|
| 195381 | 6/1906 | Germany . |
| 1962974 | 12/1969 | Germany . |
| 3535654A1 | 4/1987 | Germany . |
| 4208798A1 | 9/1993 | Germany . |
| 852938 | 11/1960 | United Kingdom . |

*Primary Examiner*—Beth A. Aubrey
*Attorney, Agent, or Firm*—Fildes & Outland, P.C.

[57] ABSTRACT

The invention relates to a process for damp-proofing masonry, in particular for the surface sealing of interior walls, by waxy substances, the waxy substance penetrating the area to be damp-proofed by being heated during a reaction time and utilising capillary forces.

In order to achieve non-destructive, ecologically harmless and durable masonry sealing which can be carried out with little expenditure, the waxy substance is brought into direct contact with the surface of a large area of the masonry to be sealed a heatable carrier, then being heated to temperatures above its melting point by heating the carrier, and thus penetrating the capillary system of the masonry, or that the waxy substance, distributed in a heatable carrier displaying a capillary system, be permanently applied to a large area of the section of masonry to be sealed, then being heated to temperatures above its melting point before or after application to the masonry, and thus spreading through the capillary system of the carrier.

24 Claims, 2 Drawing Sheets

PROCESS FOR DAMP-PROOFING MASONRY

Figure 2:
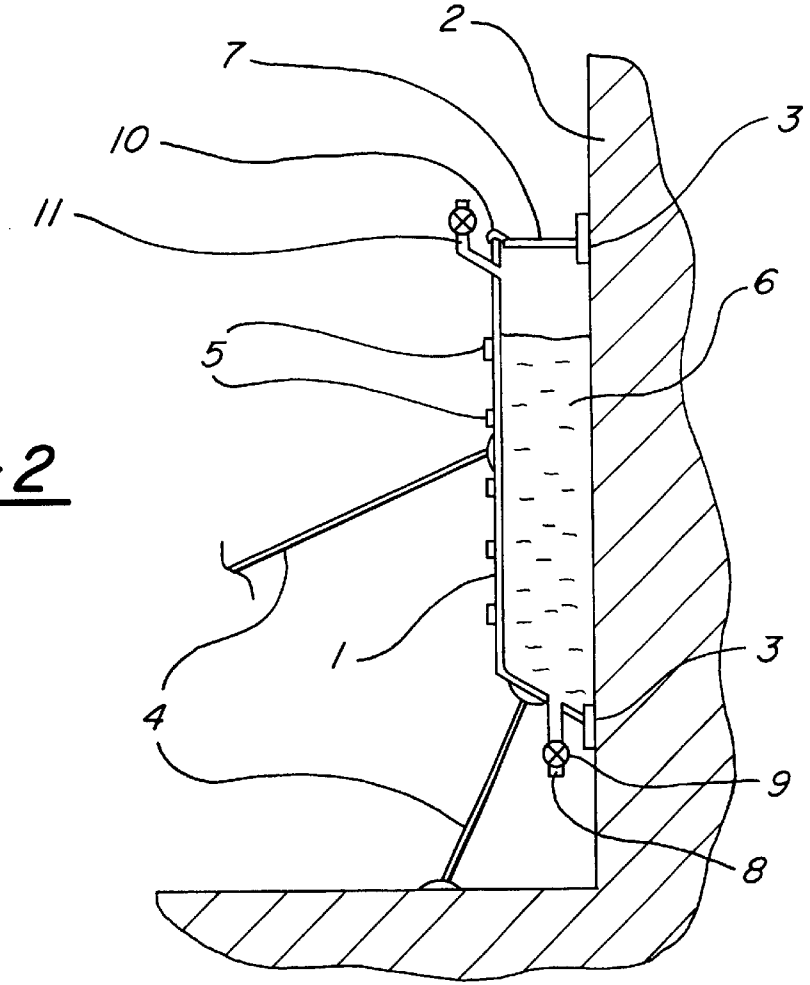

The invention relates to a process for damp-proofing masonry, in particular for the surface sealing of interior walls, by means of waxy substances.

In the sense of this invention, masonry means both building masonry, particularly interior walls and floor surfaces, as well as containers such as water tanks, stone pillars and statues and the like, which are made of natural stone or man-made building materials, such as expanded concrete blocks, and display a capillary system.

It is often necessary to seal damp masonry, as the moisture can penetrate into the adjoining interior rooms and cause damp-induced damage. This is particularly true of cellars, where the outside of the cellar wall or floor comes into contact with groundwater, pressure water or percolating water.

In order to damp-proof the masonry, exterior wall sealing is often preferred, as this protects not only the interior, but also the masonry itself, against damp-induced damage. However, exterior wall sealing is not always possible, as the exterior wall is often adjacent to a built-over area, as is the case with terraced houses, asphalted roads and the like, meaning that the exterior wall is inaccessible. Furthermore, in order to seal cellar walls, the soil would have to be excavated to make the exterior wall accessible, which involves high costs. This is particularly true of foundations or cellar floors.

It is thus often necessary to surface seal the interior walls. The use of hydraulically setting sealing slurries based on cement is known for this purpose, these being mixed with a plastic emulsion, for example an acrylic resin, for the purposes of waterproofing and applied to the wall to be sealed using a coating or stopping process. However, the insufficient resistance to pressure water and low durability of such sealing slurries prove to be disadvantageous. Furthermore, the low salt resistance which results in localised detachment of the sealing slurries applied from the masonry proves to be particularly disadvantageous if the sealing slurries do not simultaneously form a vapour barrier, i.e. if they are still permeable to water vapour. The detachment of the sealing slurries applied is caused by the fact that salts crystallise out on the inside of the masonry if the salt content of the water seeping into the masonry is high, as the water diffuses into the usually heated cellars in this case. The crystallised salts thus rupture the sealing slurries, which are only applied superficially. Furthermore, such sealing slurries are difficult to dispose of and not ecologically harmless, owing to the water-repellent plastic they contain.

Furthermore, the provision of horizontal barriers made of water-repellent material, such as paraffin, in the masonry to prevent rising damp is known from DE 35 35 654 A1, for example. To this end, blind holes are made at intervals in the wall to be treated from one side, into which melted wax or a suitable water-repellent sealing compound is injected under excess pressure, possible after predrying. Sealing compound, temperature and injection pressure are selected in such a way that the pores of the masonry around the blind hole are sealed. However, this process necessitates the sinking of blind holes in the masonry, and thus the localised destruction of the masonry. However, only non-destructive masonry sealing can be carried out on buildings or statues classified as historical monuments, in particular, as well as on walls, pillars and the like, in which the sinking of blind holes is to be avoided owing to the prevailing statics. Furthermore, surface sealing of walls, foundations and the like cannot be carried out by this process, as this would necessitate the sinking of a very large number of blind holes, and thus a great deal of labour and high costs.

Furthermore, a process for the impregnation of walls and the like, which is carried out using liquid greases and oils as impregnating liquids, is known from DE-PS 19 53 81. The impregnating liquid is heated in a heatable vessel and fed to a cavity in front of the damp wall by means of pipes. Several pipes are arranged above one another in this context, the grease cooling in the cavity being returned to the vessel by the lower pipes in order to be reheated there. However, pressure water-resistant damp-proofing of masonry cannot be carried out in a sufficiently reliable manner using this method.

The invention is thus based on the task of creating a process for damp-proofing masonry, which can be carried out in a non-destructive and ecologically harmless manner with little expenditure, which guarantees the pressure water-resistance of the sealed masonry and which is, in particular, also suitable for the sealing of large areas, such as walls and the like.

According to the invention, this task is solved in that the waxy substance which serves to block the capillaries is brought into direct contact with the surface of a large area of the section of masonry to be sealed by means of a heatable carrier, being heated to a temperature above its melting point by heating the carrier, and thus penetrating into the capillary system of the masonry, or that the waxy substance, distributed in a carrier displaying a capillary system, is permanently applied to a large area of the section of masonry to be sealed, being heated to temperatures above its melting point before or after application to the masonry, and thus spreading through the capillary system of the carrier.

Using the process according to the invention, large areas of masonry can be damp-proofed in a non-destructive manner in a single working step. For instance, the masonry of a cellar wall or a foundation can be heated to temperatures above the melting point of the waxy substance over its entire height and across a width of one meter, for example, and the waxy substance can be applied to the preheated surface using a heatable carrier. Owing to the capillary forces of the masonry, the liquid waxy substance penetrates into the capillaries of the masonry, preferably over a depth of several centimeters, until it solidifies. This waterproofs or blocks the capillary system of the masonry, protecting it against the penetration of moisture. After a section of masonry has been treated in this way, the process can be repeated on an adjacent section, so that the entire surface of an interior cellar wall, for example, can ultimately be damp-proofed. The fact that the waxy substance penetrates into the capillary system of the masonry also achieves high pressure water resistance and salt resistance of the sealing, which is also water vapour-resistant.

In this context, the depth of the damp-proofed area depends on the capillary structure and temperature of the masonry, as well as the temperature and melting point of the waxy substance. Particularly good damp-proofing is achieved if both the masonry and the waxy substance are heated to above the melting point of the latter. If necessary, the process according to the invention can also be repeated on a section of masonry which has already been treated, so that the masonry is sealed to a greater depth, and possibly through the entire cross-section.

In particular, paraffin or industrial waxes can be used as ecologically harmless waxy substances in this context.

The masonry is advantageously predryed at temperatures above 100° C., particularly preferably at approx. 120° C., before the application of the waxy substance, thus facilitating deeper penetration of the waxy substance into the masonry. For example, individual vertical strips of wall can be heated using a heating device in this context, the waxy substance being applied immediately after the target temperature of the masonry is achieved. The humidity of the room adjoining the masonry is advantageously reduced by increasing the room temperature, preferably to approx. 50° C., and/or by means of water-absorbent agents, such as silica gel, in a working step preceding the heating of the masonry. This process step can also be carried out over a relatively long period, for example over several days, thus eliminating the surface moisture and condensation water.

In a preferred version of the process, a waxy substance is applied to the masonry by applying a heatable channel to the masonry, which is open towards the masonry and whose sides and bottom are sealed against the masonry in a liquid-tight manner, and melting the waxy substance introduced into the channel. The channel can be open at the top. This ensures simple handling of the waxy substance and permits a long reaction time of the same with the masonry. Furthermore, the waxy substance can be easily heated to temperatures well above its melting point and brought directly into contact with the masonry. The channel can be secured by a frame supported on the floor or on a wall opposite the wall to be sealed. If necessary, the channel can also be supported by fastenings such as screwed connections, which are introduced into the masonry. The channel can be sealed by means of heat-resistant silicone seals, which can be cut from corresponding, commercially available matting to fit the geometry of the channel.

In this context, the channel can extend over virtually the entire height or the entire width of the wall to be sealed, meaning that large areas of the wall can be sealed in a single working step. The depth of the channel can be chosen in such a way that the quantity of waxy substance it is to hold is adapted to the absorption capacity of the masonry. In this context, the form of the channel can be adapted to that of the masonry to be sealed, meaning that church pillars and the like can be damp-proofed using semicircular channels, for example.

The process can be carried out in such a way that melted wax is introduced into the heatable channel, so as to prevent premature solidification of the waxy substance introduced into the channel. In this context, heating elements can be introduced directly into the melted waxy substance. However, the side walls and/or bottom of the channel are advantageously heated with heating elements fastened to the outside of the channel, so that localised overheating of the waxy substance is avoided.

If the channel is sealed by a cover in a gas-tight manner and provided with a pressure compensation device, waxy substance introduced into the channel in solid form can be melted there and heated to temperatures just below the decomposition point owing to the gas-tight seal. This ensures high operating safety, as well as protecting the room adjoining the masonry treated against vapours from the waxy substance. In this context, a closeable outlet can be provided on the bottom of the channel, so that the waxy substance remaining in the channel at the end of the process can be easily removed from the channel before it solidifies. The outlet can be directly connected to a collecting tank, via a pump for example. Liquid siphons can also be used instead.

In order to aid the penetration of the waxy substance into the masonry, the pressure compensation device can also be designed so that excess pressure can be set inside the channel via a corresponding pressure generating device.

However, sufficient sealing of the masonry can often already be achieved if the melted waxy substance is introduced into a heated channel which is open at the top. On suitable masonry, horizontal barriers, i.e. sealing over the entire depth of the masonry, can also be achieved using this process. As channels with opening cross-sections of several square metres facing the masonry can be used in this context, rapid and effective sealing of the masonry is possible.

In another version of the process, the waxy substance can be applied to the masonry by means of wax-impregnated, large-area, flexible carrier materials. In particular, textile fabrics or foams can be advantageously used as carrier materials. In this context, it may be sufficient to bring the wax-impregnated, flexible carrier material into contact with the preheated masonry under manual pressure.

The penetration of the waxy substance into the masonry is advantageously aided by the flexible carrier material being pressurised against the masonry by means of a large-area ram, so that the waxy substance is pressurised when penetrating the masonry. Pressures of several bar can be achieved in this context. The flexible carrier material serves as a reservoir stock for the waxy substance in this context, there being the possibility of adjusting the thickness of the layer of textile carrier material to the absorption capacity of the masonry for the waxy substance.

Furthermore, the penetration of the waxy substance into the capillary system of the masonry is aided by the ram preferably being heated to above the melting point, but to no more than the decomposition temperature of the wax.

If the ram is sealed against the masonry by a collar on all sides, both the contact pressure and the temperature of the wax can be varied over wide ranges, while simultaneously ensuring high operating safety.

In another advantageous version of the process, the surface of the masonry to be sealed is provided with a wall covering containing the waxy substance and the wall covering applied is heated to above the melting point of the waxy substance. This initially distributes the waxy substance in the capillary system of the wall covering, already providing sufficient damp-proofing. However, if the temperature and reaction time are suitable, the waxy substance can also penetrate the capillary system of the adjoining masonry, achieving deeper sealing of the masonry. In this context, it has proved to be particularly advantageous that the temperatures necessary to damp-proof the wall are lower than those in the process previously described, owing to the distribution of the wax in the wall covering. For example, wall heating to 80° C. instead of approx. 120° C. is sufficient if using paraffin.

In this context, a water-tight seal can be applied to the masonry between the masonry and the wall covering—by means of the known hydraulically setting sealing slurries, for example. This permits the drying-out of the wall covering, even if it is applied to masonry which is still damp. As the outside of the sealing slurries is covered by a mechanically stable wall covering, localised detachment of the sealing slurries owing to salt crystallisation is also prevented.

In this context, the wall covering can consist of a porous insulating board, such as a calcium silicate board, or a plaster containing the waxy substance.

The waxy substance is advantageously added to the wall covering in the form of beads or as a suspension during its manufacture, thus facilitating uniform distribution of the wax and easy manufacture of the wall covering. The insulating boards can also already be provided with the waxy substance at the factory by means of melt impregnation.

Figure 1:
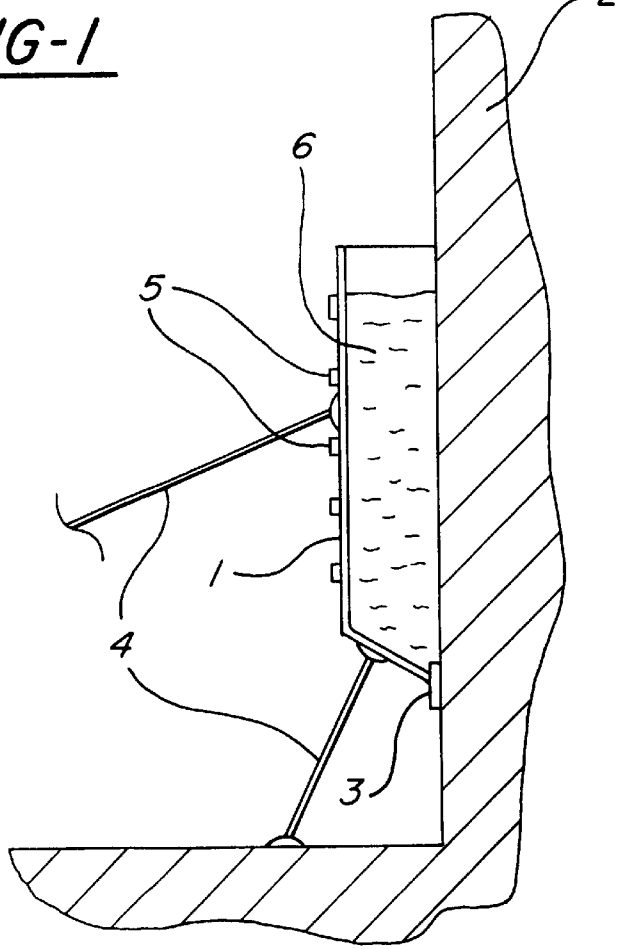
Figure 4:
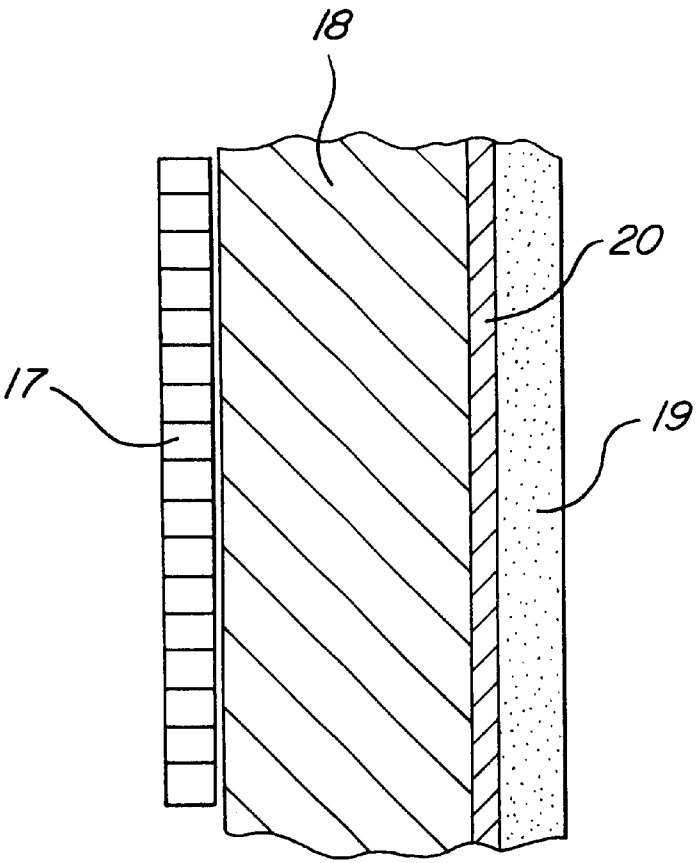
Figure 3:
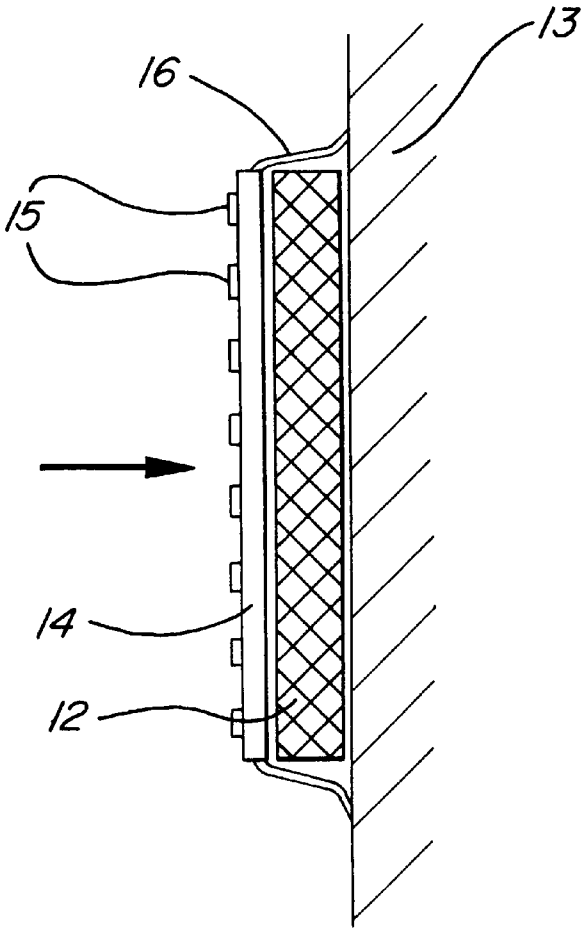

Preferred configurations of the invention are described below and illustrated by way of example on the basis of the figures. The figures show the following:

FIG. 1 A device for implementing the process according to the invention by means of an open-top channel arranged on the masonry to be sealed, FIG. 2 A device for implementing the process according to the invention by means of a closeable channel arranged on the masonry to be sealed, FIG. 3 A device for implementing a further version of the process by means of wax-impregnated, large-area, flexible carrier materials and FIG. 4 An implementation of the process according to a further version by means of insulating boards (left) and insulating plaster (right).

The waxy substance can be applied to the masonry to be sealed by means of channel 1 shown in FIG. 1. Open-top channel 1, which is approx. 2 m long and approx. 1 m high, is open towards wall 2 to be sealed and sealed against this by seal 3 made of heat-resistant silicone. Channel 1 is supported on the bottom and rear by rods 4 and is pressurised against wall 2, so that channel 1 lies closely against wall 2. Rods 4 can also be designed as lifting rods secured in the floor in this context, permitting easy adjustment of the height of channel 1, as well as displaying a swivelling mount which pressurises the channel against the wall.

The bottom and rear of channel 1 display heating elements 5 which are designed as a flexible heating coil which can be fastened to channel 1 using adhesive tape in the simplest case. This allows simple adjustment of the heated area of channel 1 to the respective requirements.

Channel 1 is filled with paraffin 6, which is introduced into channel 1 in molten state, or which can be melted therein. The fact that the top of channel 1 is open means that the channel can be easily filled and the process easily monitored on the basis of the liquid level in the channel. The melted paraffin 6, which comes into contact with wall 2 to be sealed, penetrates the capillary system of the masonry owing to the capillary forces, displaces any moisture in the masonry and waterproofs or blocks the capillaries of the masonry, so that the latter becomes impermeable to water and the room adjoining the masonry is protected against damp.

In the configuration shown in FIG. 2, channel 1 is additionally provided with a closeable cover 7, which is sealed against wall 2 by means of seal 3. Paraffin 6 in channel 1 can thus be heated to temperatures well above its melting point, without paraffin vapours being admitted into the room adjoining wall 2.

Furthermore, the bottom of channel 1 is provided with an outlet 8, which can be closed by means of valve 9, so that any liquid paraffin still in channel 1 after the process is completed can be easily removed via outlet 8. The fact that cover 7 can be locked by means of a locking device 10 and that the channel is provided with pressure compensation device 11 means that liquid paraffin 6 in channel 1 can be provided with slight excess pressure by means of a pressure generation device (not shown) connectable to pressure compensation device 11, thus aiding its penetration into the capillary system of the masonry. If necessary, the masonry can also be predryed.

When implementing the process according to the invention using a channel of the configuration described above, both large-area sealing of walls to a depth of several centimeters and the easy, non-destructive formation of horizontal barriers to prevent rising damp are possible, the sealed area of masonry extending over the entire cross-section of the wall. Semicircular channels can, for example, also be used to seal round pillars in churches, etc.

In a further version, the process can be implemented in such a way that the paraffin is applied to the masonry to be sealed (possibly after reducing the moisture content in the room and the walls and predrying) by means of paraffin-impregnated, large-area, flexible carrier materials, such as woven textile fabrics.

The paraffin can be introduced into the masonry by applying paraffin-impregnated matting of a flexible carrier material, such as cotton or plastic woven fabric 12, to a large area of masonry 13 (FIG. 3). In this context, the paraffin is melted and penetrates the capillary system of the masonry. The carrier material prevents melted paraffin running down the heated wall. Woven matting 12 is pressed onto masonry 13 via a hydraulically activated ram 14, ensuring close contact with masonry 13 and facilitating deeper penetration of the paraffin into the capillary system of the masonry owing to the pressure. Furthermore, ram 14 is provided with heating elements 15, so that premature solidification of the paraffin is prevented, ram 14 being encompassed by an elastically deformable collar 16, which contacts the masonry in a sealing manner and is elastically deformed during pressurisation of woven matting 12 by ram 14, so that ram 14 is constantly in contact with woven matting 12. The capillary system of woven matting 12 ensures that the melted paraffin is uniformly distributed over the height of the masonry on vertical walls, and that sufficient sealing is not only provided in the lower area of woven matting 12.

It goes without saying that the masonry and the adjoining room can also be predryed when sealing masonry by means of the channel shown in FIG. 1. Furthermore, in order to ensure sufficient process control, heating elements 5 and 15 can be designed as controllable elements, and temperature sensors can be attached to channel 1 and/or ram 14, in the case of the devices suitable for implementing the process according to FIG. 1 and FIG. 2.

In a further version of the process (see FIG. 4, left), insulating boards 17, which are provided with the waxy substance, are fixed to the wall to be sealed. For example, calcium silicate boards, in which the paraffin is incorporated in the form of beads, can be used as insulating boards. However, the insulating boards can also be impregnated with melted paraffin, owing to their porous structure. The insulating boards display sufficient strength, meaning that they can be fixed to wall 18 by means of nails, dowels and the like. However, the insulating boards can also be fixed to the wall by means of a cement or gypsum plaster, meaning that adequate damp-proofing of the interior room can already be achieved in this way. Insulating boards 17 fixed to wall 18 can, however, also be subsequently heat-treated, which causes the paraffin to melt and penetrate the masonry. When implementing the process in this manner, wall 18 is advantageously predryed, as described above.

FIG. 4 (right) shows damp-proofed masonry covered by plaster 19 containing paraffin beads. Generally known cement or gypsum plasters can be used in this context.

Plaster 19, which is applied in the usual manner, is then also heated to temperatures above the melting point of the paraffin, meaning that the paraffin is uniformly distributed in the plaster. In this context, a sealing layer 20 consisting of sealing slurries is inserted between plaster 19 and wall 18, so that the plaster is protected against moisture seeping out of the masonry and can dry out before it is heated. This reduces the risk of cracks forming in the plaster, as well as lowering the drying temperature of the plaster, compared to a process version without a sealing layer.

LIST OF REFERENCE NUMBERS

1 Cannel
2 Wall
3 Seal
4 Rods
5 Heating element
6 Paraffin
7 Cover
8 Outlet
9 Valve
10 Locking device
11 Pressure compensation device
12 Woven matting
13 Masonry
14 Ram
15 Heating element
16 Collar
17 Insulating board
18 Wall
19 Plaster
20 Sealing layer

What is claimed is:

1. A process for damp-proofing masonry comprising the steps of:

providing a solid waxy substance;

abutting a heatable carrier containing the waxy substance against a surface of the masonry;

heating the carrier and the waxy substance above the melting point of the waxy substance to melt the waxy substance;

maintaining the waxy substance in a melted state; and utilizing capillary forces to allow the melted waxy substance to penetrate the surface of the masonry.

2. A process as in claim 1 further comprising the step of predrying the masonry at temperatures above 100° C. prior to abutting the heatable carrier.

3. A process as in claim 2 further comprising the step of reducing the humidity of a room adjoining the masonry prior to predrying the masonry.

4. A process as in claim 1 wherein the heatable carrier is a channel having a bottom wall, side walls extending from the bottom wall and an open side, said side walls being sealed against the masonry in a liquid-tight manner and said open side being adjacent the masonry.

5. A process as in claim 4 further comprising the steps of:

covering the channel in a gas-tight manner; and providing a pressure compensation device to provide pressure within the channel to aid the penetration of the waxy substance into the surface of the masonry.

6. A process as in claim 1 wherein the heatable carrier is a wall covering containing the waxy substance.

7. A process as in claim 6 further comprising the step of applying a water-tight sealing layer to the masonry between the masonry and the wall covering prior to applying the wall covering.

8. A process as in claim 6 wherein the wall covering is one of porous insulating boards and plaster.

9. A process as in claim 6 wherein the waxy substance is disposed within the walling cover in the form of beads.

10. A process as in claim 1 wherein the heatable carrier is a wax-impregnated flexible carrier material.

11. A process as in claim 10 further comprising the step of pressurizing the flexible carrier material against the masonry by using a ram prior to heating the carrier material.

12. A process as in claim 11 further comprising the step of heating the ram to heat the waxy substance above the melting point of the waxy substance after pressurizing the carrier material against the masonry.

13. A process as in claim 11 further comprising the step of sealing the ram against the masonry by surrounding all sides of the ram with a collar prior to pressurizing the carrier material.

14. A device for damp-proofing masonry comprising:

a heatable channel containing a solid waxy substance;

said heatable channel having a bottom wall and side walls extending from the bottom wall and an open side, said side walls being sealed against the masonry in a liquid-tight manner and said open side being adjacent an outer surface of the masonry; and support means for supporting the carrier against the outer surface of the masonry;

whereby the waxy substance can be applied to the entire surface of the masonry without destroying the masonry.

15. A device as in claim 14 wherein the channel includes heating elements fastened to one of the bottom and side walls of the channel to heat the channel and the waxy substance above the melting point of the waxy substance.

16. A device as in claim 14 wherein the channel includes a cover closing an open top of the channel to provide a gas-tight seal between the masonry and the carrier to prevent vapors from the waxy substance from being admitted into the surrounding area and a pressure compensation device attached to the channel to provide pressure within the channel to aid the penetration of the waxy substance into the surface of the masonry.

17. A device for damp-proofing masonry comprising:

a wax-impregnated flexible carrier material; and support means for supporting the carrier material against an outer surface of the masonry while the waxy substance penetrates a capillary system of the masonry;

whereby the waxy substance can be applied to the masonry without destroying the masonry.

18. A device as in claim 17 wherein the support means is a ram that pressurizes the flexible carrier material against the masonry.

19. A device as in claim 18 wherein the ram is heatable.

20. A device as in claim 18 wherein the ram includes a collar surrounding sides of the ram to seal the ram against the masonry.

21. A device for damp-proofing masonry comprising:

a heatable carrier having a capillary system to receive a waxy substance and being made from a material enabling the waxy substance to be distributed in the capillary system of the carrier by heating the carrier; and fixing means for attaching the carrier against an outer surface of the masonry while the waxy substance penetrates a capillary system of the masonry;

whereby the waxy substance can be applied to the masonry without destroying the masonry.

22. A device as in claim 21 wherein the heatable carrier is one of porous insulating boards and plaster.

23. A device as in claim 22 wherein the waxy substance is incorporated into the heatable carrier in the form of beads.

24. A process for damp-proofing masonry comprising the steps of:

providing a solid waxy substance;

abutting a heatable carrier having a capillary system and containing the waxy substance against a surface of the masonry;

heating the heatable carrier and the waxy substance to temperatures above the melting point of the waxy substance to melt the waxy substance;

maintaining the waxy substance in a melted state; and utilizing capillary forces to allow the melted waxy substance to penetrate the surface of the masonry.

* * * * *